US005658864A

United States Patent [19]

Macpherson

[11] Patent Number: 5,658,864

[45] Date of Patent: Aug. 19, 1997

[54] BIODEGRADABLE POUR POINT DEPRESSANTS FOR INDUSTRIAL FLUIDS DERIVED FROM BIODEGRADABLE BASE OILS

[75] Inventor: Ian Macpherson, Richmond, Va.

[73] Assignee: Ethyl Corporation, Va.

[21] Appl. No.: 409,577

[22] Filed: Mar. 24, 1995

[51] Int. Cl.[6] ..... C10M 143/08; C10M 105/38

[52] U.S. Cl. ..... 508/491

[58] Field of Search ..... 252/565; 508/491

[56] References Cited

U.S. PATENT DOCUMENTS

| | | | |
|---|---|---|---|
| 3,763,244 | 10/1973 | Shubkin | 252/56 S |
| 4,519,932 | 5/1985 | Schnur et al. | 252/56 S |
| 4,783,274 | 11/1988 | Jokinen et al. | 252/56 S |
| 5,254,272 | 10/1993 | Walters et al. | 252/32.7 |
| 5,338,471 | 8/1994 | Lal | 252/56 S |
| 5,378,249 | 1/1995 | Morrison | 252/56 S |
| 5,451,334 | 9/1995 | Bongardt et al. | 252/56 S |

FOREIGN PATENT DOCUMENTS

| | | |
|---|---|---|
| 434 464 A1 | 6/1991 | European Pat. Off. . |
| 468 109 A1 | 1/1992 | European Pat. Off. . |
| 572 866 A1 | 12/1993 | European Pat. Off. . |
| 604 125 A1 | 6/1994 | European Pat. Off. . |

*Primary Examiner*—Jerry D. Johnson

*Attorney, Agent, or Firm*—Dennis H. Rainear; Thomas Hamilton

[57] ABSTRACT

The invention involves the use of biodegradable polyalpha olefins ("PAOs") to treat biodegradable industrial fluids, such as lubricants, hydraulic fluids, fuel oils, and the like, to: (a) reduce their pour point; (b) improve their oxidation stability performance; and/or, (c) improve their hydrolytic stability performance. A preferred industrial fluid is mixture of vegetable oil and branched alkane where the average molecular weight of the alkane is about 200–400, and the alkane additionally has a sufficient degree of branching to have a pour point of about −25° C. or lower.

1 Claim, No Drawings

BIODEGRADABLE POUR POINT DEPRESSANTS FOR INDUSTRIAL FLUIDS DERIVED FROM BIODEGRADABLE BASE OILS

FIELD OF THE INVENTION

The present invention relates to the use of biodegradable polyalpha olefins as pour point depressants for industrial fluids based on biodegradable vegetable oils, including but not limited to natural or synthetic triglycerides or their esters. Preferred vegetable oils are rapeseed oil, soybean oil, and canola oil.

BACKGROUND OF THE INVENTION

Unfortunately, oils, hydraulic fluids, and other petroleum-based products almost inevitably leak onto pavement or other ground surfaces, eventually resulting in contamination of the environment. Much effort has been directed to avoiding such contamination. Since total containment of petroleum-based products may not be possible, efforts recently have focused on altering petroleum products to render those products less toxic to the environment. One promising approach has been to replace the base fluid—typically, a petroleum-derived hydrocarbon—with a vegetable oil, such as a naturally occurring or synthetic triglyceride or ester thereof. Vegetable oils are biodegradable, and thus environmentally friendly.

Unfortunately, triglycerides have poor low temperature viscometrics, and tend to congeal at temperatures below about −10° C. (14° F.). Many industrial fluids must have a pour point of less than −25° C. (−13° F.) and a Brookfield viscosity of 7500 to 110,000 centiPoise (cP) at −25° C. (−13° F.). In order for triglycerides to be used successfully as industrial base fluids, their low temperature viscometry must be improved.

A number of compounds are known to improve the low temperature viscometrics of vegetable oils. These compounds are known as "pour point depressants"(PPD's). Known PPD's for triglycerides include, but are not limited to: modified carboxy containing interpolymers; acrylate polymers; nitrogen containing acrylate polymers; and, methylene linked aromatic compounds. Unfortunately, known PPDs are not biodegradable. Therefore, the advantage in low temperature viscometry that is gained by using these PPD's is largely offset by the decrease in biodegradability of the resulting product. Also, manufacturing and environmental specifications limit the total amount of non-biodegradable material that can be used in a particular industrial fluid.

Biodegradable PPDs, which would meet the applicable specifications and not compromise the overall biodegradability of industrial fluids, are sorely needed.

SUMMARY OF THE INVENTION

The invention involves the use of biodegradable polyalpha olefins ("PAOs") to treat biodegradable industrial fluids, such as lubricants, hydraulic fluids, fuel oils, and the like, to: (a) reduce their pour point; (b) improve their oxidation stability performance; and/or, (c) improve their hydrolytic stability performance. A preferred industrial fluid is mixture of vegetable oil and branched alkane where the average molecular weight of the alkane is about 200–400, and the alkane additionally has a sufficient degree of branching to have a pour point of about −25° C. or lower.

DETAILED DESCRIPTION OF THE INVENTION

The Vegetable Oils

Typical vegetable oils that may be used in the present invention include castor oil, olive oil, peanut oil, rapeseed oil, corn oil, sesame oil, cottonseed oil, soybean oil, canola oil, sunflower oil, safflower oil, hemp oil, linseed oil, tung oil, citicica oil, jojoba oil, meadowfoam oil, and the like. Such oils may be partially or fully hydrogenated, if desired.

Suitable synthetic oils comprise the esters of dicarboxylic acids (e.g., phthalic acid, succinic acid, maleic acid, azelaic acid, suberic acid, sebacic acid, fumaric acid, adipic acid, mellitic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(triisodecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, and 2-ethylhexyl diester of linoleic acid dimer, the mixed nonyl/undecyl ester of phthalic acid, and the complex ester formed by reacting one mole of sebacic acid with two moles of tetraethylene glycol and two moles of 2-ethylhexanoic acid.

Other esters which may be used include those made from $C_3$–$C_{18}$ monocarboxylic acids and polyols and polyol ethers such as neopentyl glycol, trimethylolpropane, pentaerythritol and dipentaerythritol. Trimethylolpropane tripelargonate, tri-methylolpropane trinonanoate, pentaerythritol tetracaproate, the ester formed from trimethylolpropane and a mixture of octanoic and decanoic acids, the ester formed from trimethylolpropane, caprylic acid and sebacic acid, and the polyesters derived from a $C_4$–$C_4$ dicarboxylic acid and one or more aliphatic dihydric $C_3$–$C_{12}$ alcohols such as derived from azelaic acid or sebacic acid and 2,2,4-trimethyl-1, 6-hexanediol, serve as examples.

Preferred forms of these oils are high oleic forms, such as high oleic rapeseed oil, high oleic safflower oil, high oleic corn oil, high oleic sunflower oil, high oleic soybean oil, high oleic cottonseed oil, and high oleic palm olein. A preferred vegetable oil is high oleic rapeseed oil, which may be obtained from a number of sources. The rapeseed oil used herein was "RISSO FOR CHEFS," and may be obtained form Van de Moortele, in either Oudenbosch, Holland, or Ghent, Belgium.

As used herein, the term "triglycerides" shall refer to naturally occurring and synthetic biodegradable triglycerides and their esters. Triglycerides that are useful in the present invention generally have the following formula:

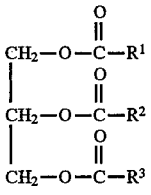

wherein $R^1$, $R^2$, and $R^3$ are independently selected from aliphatic hydrocarbyl groups preferably having at least 60 percent monounsaturated character and containing from about 6 to about 24 carbon atoms. As used herein, the term "hydrocarbyl group" denotes a radical having a carbon atom directly attached to the remainder of the molecule, and includes:

(1) aliphatic hydrocarbon groups: alkyl groups, such as heptyl, nonyl, undecyl, tridecyl, and heptadecyl groups;

alkenyl groups containing a single double bond, such as heptenyl, nonenyl, undecenyl, tridecenyl, heptadecenyl, heneicosenyl groups; and, alkenyl groups containing 2 or 3 double bonds, such as 8,11-heptadecadienyl and 8,11,14-heptadecatrienyl groups. All isomers of the foregoing are acceptable, but straight chain groups are preferred;

(2) Substituted aliphatic hydrocarbon groups: groups containing non-hydrocarbon substituents which, in the context of the present invention, do not alter the predominantly hydrocarbon character of the group. Persons skilled in the art will be aware of suitable substituents, examples being hydroxy, carbalkoxy (especially lower carbalkoxy), and alkoxy (especially lower alkoxy) groups, the term "lower" denoting groups containing not more than 7 carbon atoms;

(3) Hetero groups: groups which, while predominantly aliphatic hydrocarbon in character in the context of this invention, contain atoms other than carbon present in a chain or ring otherwise composed of aliphatic carbon atoms. Suitable hereto atoms will be apparent to those skilled in the art and include, for example, oxygen, nitrogen, and sulfur.

Regardless of the source of the triglyceride, the fatty acid moieties preferably should be such that the triglyceride has a monounsaturated character of at least 60 percent, preferably at least 70 percent, and most preferably at least 80 percent. For example, a triglyceride comprising exclusively an oleic acid moiety has an oleic acid content of 100% and consequently a monounsaturated content of 100%. Where the triglyceride is made up of acid moieties that are 70% oleic acid, 10% stearic acid, 5% palmitic acid, 7% linoleic acid, and 8% hexadecanoic acid, the monounsaturated content is 78%. Preferably, the monounsaturated character is derived from an oleyl radical, i.e., $$R^1-\overset{O}{\overset{\|}{C}},\ R^2\overset{O}{\overset{\|}{C}},\ \text{and}\ R^3\overset{O}{\overset{\|}{C}}$$

is the residue of oleic acid. Preferred triglycerides are high oleic acid (at least 60 percent) triglyceride oils.

The Polyalpha Olefins

The present invention involves the discovery that certain biodegradable polyalpha olefins act as pour point depressants for certain vegetable oils, particularly triglycerides. PAO's are known to have high oxidation and hydrolytic stability; therefore, to the extent that the PAO is present in the vegetable oil, the PAO also should increase the oxidation and hydrolytic stability performance of the vegetable oil.

PAO's that are biodegradable are formed by (a) oligomerization of 1-alkene hydrocarbons having between about 6 to 20 carbon atoms, and (preferably) (b) hydrogenation of the resultant oligomer. Preferred biodegradable PAO's are branched alkanes with an average molecular weight of about 200–400 and a sufficient degree of branching to reduce the pour point of an industrial fluid to about −25° C. or lower. By "biodegradable" is meant that the PAO in question has a biodegradability when tested and reported in accordance with the well known test method CEC L-33-T-82 of at least 20%, preferably at least 30%, and more preferably at least 40%.

Not all hydrogenated 1-alkene hydrocarbon liquid oligomers are "biodegradable." To verify that a particular PAO is biodegradable, recourse should be had to the CEC L-33-T-82 test procedure to determine the % biodegradability of the oligomer under consideration. Some unhydrogenated or partially unsaturated forms of PAO may possess the desired biodegradability. Generally, hydrogenated liquid oligomers of linear 1-alkenes containing at least 50% dimer, trimer, and/or tetramer formed using a water or alcohol promoted Friedel-Crafts catalyst tend to possess the requisite biodegradability, and thus are preferred. Particularly preferred are liquid hydrogenated oligomers of linear 1-alkenes containing at least 80 or 90% dimer and/or codimer species. The 1-alkenes that are used to form such oligomers should contain from between about 6 to 20 carbon atoms and preferably from between about 8 to 16 carbon atoms. In addition, such 1-alkenes should be linear (i.e., substantially free of branching and cyclization).

Methods for producing substantially biodegradable polyalpha olefins are known, and reported in the literature. Examples are U.S. Pat. Nos. 3,763,244; 3,780,128, 4,172,855, and 4,218,330, incorporated herein by reference. Additionally, PAO's are available commercially, for example, Ethyl Petroleum Additives, Inc. as HITEC® 162, HITEC® 164, HITEC® 166, AND HITEC® 168. Preferred PAO's are 1-decene oligomers having a high ratio of dimer content, as opposed to trimer or tetramer content. A most preferred PAO is a 2 centistoke polyalpha olefin available from Ethyl Petroleum Additives, Inc. under the trademark HITEC® 162. Suitable PAO's also may be available from other suppliers.

The preferred hydrogenated oligomers of this type have little, if any, residual ethylenic unsaturation. Preferred oligomers are formed using (a) a Friedel-Crafts catalyst (especially boron trifluoride promoted with water or a $C_{1-20}$ alkanol), followed by (b) catalytic hydrogenation of the resulting oligomer using procedures such as those described in the foregoing U.S. Patents. Other suitable catalyst systems include Zeigler catalysts, such as ethyl aluminum sesquichloride with titanium tetrachloride, aluminum alkyl catalysts, chromium oxide catalysts on silica or alumina supports, and a system in which a boron trifluoride catalyst oligomerization is followed by treatment with an organic peroxide.

Mixtures or blends of PAOs also can be used as a pour point depressant in the present invention, provided that the overall blend possesses the requisite biodegradability. The PAO's of the present invention preferably should be used without adding other, non-biodegradable pour point depressants to the triglyceride.

The PAO may be added in any desired quantity. In most applications, the PAO—alone—would be a functional industrial fluid. However, vegetable oils such as rapeseed oil are much less expensive than PAO's. Therefore, it is desirable to minimize the amount of PAO that is used in the industrial fluid. In order to adequately suppress the pour point of a triglyceride-based fluid, the PAO preferably should be added in a range of about 12–20 wt %, most preferably about 15 wt %.

Other well known additives also may be added to the base fluid, provided that these additives are miscible with the vegetable oil and the PAO, and do not substantially interfere with the biodegradability of the overall composition. Such additives include wear inhibitors, detergents, viscosity index improvers, friction modifiers, fuel economy additives, antioxidants or thermal stabilizers, dispersants, extreme pressure agents, tackiness additives, rust inhibitors, wax modifiers, foam inhibitors, copper passivators, sulfur scavengers, seal swell agents, color stabilizers, and like materials. Where such additives are used, the PAO may be included in the additive, for example, as a biodegradable processing oil.

The invention will be more clearly understood with reference to the following examples:

EXAMPLE 1

In this example, "RISSO FOR CHEFS" rapeseed oil, obtained from Van de Moortele, was mixed with 15% by weight HITEC® 162, obtained from Ethyl Petroleum Additives, Inc. The mixture was stirred and heated to about 50° C. (122° F.), and the pour point was determined using the Institute of Petroleum test method IP-15. The results, which demonstrate the operability of the invention, are shown in Table I:

TABLE I

| COMPONENT | % (wt) | % (wt) | % (wt) | % (wt) | % (wt) | % (wt) |
|---|---|---|---|---|---|---|
| H162* | — | 1.0 | 2.0 | 5.0 | 10.0 | 15.0 |
| Rapeseed oil | 100.0 | 99.0 | 98.0 | 95.0 | 90.0 | 85.0 |
| Pour point (°C./°F.) | −21° C./ −5.8° F. | −21° C./ −5.8° F. | −21° C./ −5.8° F | −21° C./ −5.8° F. | −24° C./ −11.2° F. | −36° C. −32.8° F. |

*"HI62" stands for HITEC ® 162.

EXAMPLE 2

In the following experiment, the same procedures as given in Example 1 were used with the same PAO and the same triglyceride; however, a second, non-biodegradable pour point depressant also was added. The non-biodegradable PPD was HITEC® 623 ("H623"), a polymethacrylate product obtained from Ethyl Petroleum Additives, Inc. The results, which demonstrate a correlation between pour point and the amount of PAO added, are given in Table II:

TABLE II

| COMPONENT | % (wt) | % (wt) | % (wt) | % (wt) |
|---|---|---|---|---|
| H162 | 2.0 | 5.0 | 10.0 | 15.0 |
| Rapeseed Oil | 97.0 | 94.0 | 89.0 | 84.0 |
| H623 | 1.0 | 1.0 | 1.0 | 1.0 |
| Pour Point °C./°F. | −33° C./ −27.4° F. | −33° C./ −27.4° F. | −36° C./ −32.8° F. | −36° C./ −32.8° F. |

EXAMPLE 3

The procedures of Example 1 were followed to test the PAO alone, and in combination with several different non-biodegradable PPDs, including HITEC® 623, tested in Example 2, and HITEC® 672, a styrene acrylate obtained from Ethyl Petroleum Additives, Inc. The comparative results are shown in Table III:

TABLE III

| Component | COMPARISON % (wt) | COMPARISON % (wt) | COMPARISON % (wt) | COMPARISON % (wt) | INVENTION % (wt) |
|---|---|---|---|---|---|
| H162 | — | — | — | 2.0 | 15.0 |
| H672 | — | — | 1.0 | 1.0 | — |
| H623 | — | 1.0 | — | — | — |
| Rapeseed Oil | 100 | 99.0 | 99.0 | 97.0 | 85.0 |
| Pour Point °C./°F. | −21° C./ −5.8° F. | −30° C./ −22° F. | −33° C./ −27.4° F. | −33° C./ −27.4° F. | −36° C./ −32.8° F. |

The foregoing results demonstrate that non-biodegradable PPD's, alone, lowered the pour point of rapeseed oil, and that the addition of PAO in association with these non-biodegradable PPDs did not alter the pour point further. However, as also seen in Examples 1 and 2, the use of larger amounts of PAO, alone, lowered the pour point as effectively as the non-biodegradable PPDs, alone.

In this manner, the methods and compositions of the present invention can be used to treat biodegradable industrial fluids, such as lubricants, hydraulic fluids, fuel oils, and the like, to: (a) reduce their pour point; (b) improve their oxidation stability performance; and/or, (c) improve their hydrolytic stability performance.

Persons of skill in the art will appreciate that many modifications may be made to the embodiments described herein without departing from the spirit of the present invention. Accordingly, the embodiments described herein are illustrative only and are not intended to limit the scope of the present invention.

I claim:

1. A method for depressing the pour point of an industrial fluid comprising at least one triglyceride, said method comprising the step of adding to said industrial fluid a pour point depressant consisting essentially of one or more biodegradable polyalpha olefins comprising branched alkenes with an average molecular weight and a sufficient degree of branching to reduce the pour point of said industrial fluid to about −25° C. or lower, wherein said alkenes comprise unhydrogenated oligomerization products of 1-alkenes having between about 6 to 20 carbon atoms.

* * * * *